United States Patent [19]

Hill

[11] Patent Number: 4,819,938

[45] Date of Patent: Apr. 11, 1989

[54] GOLF BALL AND TEE PLACEMENT AND RETRIEVAL TOOL

[76] Inventor: Norman C. Hill, Ocean Parks E-204, Jupiter, 300 A-l-A, Fla. 33458

[21] Appl. No.: 79,041

[22] Filed: Jul. 29, 1987

[51] Int. Cl.[4] ..... A63B 57/00

[52] U.S. Cl. ..... 273/32.5; 273/32 B; 294/19.2

[58] Field of Search ..... 273/32.5, 77 R, 33, 273/32 B; 221/297; 294/19.1, 19.2

[56] References Cited

U.S. PATENT DOCUMENTS

| | | | |
|---|---|---|---|
| 2,609,198 | 9/1952 | Armstrong | 273/32.5 |
| 2,943,856 | 7/1960 | Eimerman | 273/32.5 |
| 3,206,197 | 9/1965 | Miotke | 273/32.5 |
| 3,889,946 | 6/1975 | Setecka | 273/32.5 |
| 3,904,200 | 9/1975 | Jackle | 273/32.5 |
| 4,313,604 | 2/1982 | Baxter | 273/32 A |
| 4,466,650 | 8/1984 | Roedel | 273/32.5 |
| 4,526,369 | 7/1985 | Phelps | 273/32 B |

*Primary Examiner*—Richard C. Pinkham
*Assistant Examiner*—T. Brown
*Attorney, Agent, or Firm*—Dowell & Dowell

[57] ABSTRACT

An appartus for enabling the remote handling and placement of golf balls and tees by an individual without requiring the individual to bend or stoop and which includes an elongated handle having a pair of generally concave opposing jaw portions which are selectively movable relative to one another and from which extend a pair of generally concave gripping elements which may be utilized to selectively engage a golf ball or golf tee and which further includes a cup for allowing the selective placement of the golf ball and golf tee relative to one another prior to inserting or setting the golf ball and tee into the ground.

8 Claims, 2 Drawing Sheets

GOLF BALL AND TEE PLACEMENT AND RETRIEVAL TOOL

BACKGROUND OF THE INVENTION

1. Field of the Invention

This invention is generally directed to tools or equipment which may be utilized to facilitate the handling of golf balls and golf tees and more particularly to a golf ball and tee placement and/or retrieval tool which permits either the simultaneous placement or setting of the ball and tee or the selective retrieval of a ball or tee from the ground or from the cup on a golf green. The tool of the present invention is designed to enable a golfer to accomplish the placement and retrieval of balls and tees without requiring any bending motion thereby enabling individuals who have back problems to be self-sufficient when playing a game of golf. The structure of the present invention not only permits the golf ball and golf tee to be held in a closely associated manner for simultaneously placing the ball on the tee while the tee is being inserted into the ground but also permits the tool to be utilized to grasp a tee from the ground or retrieve the ball from the ground or the cup on the golf green. The tool is designed to be lightweight and may be carried on the golfer's belt and is designed to be economically manufactured thereby enabling the tool to be made available to consumers at relatively low cost.

2. History of the Invention

Over the years, many innovations have been developed to assist persons playing golf. A number of these tools or implements have been specifically designed to aid individuals suffering from various physical maladies thereby making it possible for such individuals to be more self-sufficient when playing the game of golf.

The game of golf is a rather unique sport in that it not only requires skill and therefore is challenging to a player but also enables many people to obtain physical exercise and activity which is beneficial to both their mental and physical well-being. As a sport, golf is particularly advantageous for senior adults and other persons who are not able to participate in more stressful sports or exercises. Due to the obvious benefits which are obtained by playing the game of golf, golf courses have become popular additions to many new retirement communities.

Unfortunately, there are many individuals who suffer from physical disabilities which make it difficult for them to be totally self-sufficient when playing the game of golf. In particular, many people suffer from back injuries or diseases or have other muscle control problems which prevent them from effectively bending or stooping thereby making it practically impossible for such individuals to position a ball on a tee or retrieve the tee or ball from the ground after a hole has been played.

In order to assist individuals who have physical limitations which make it difficult for them to bend or stoop while playing golf, a number of implements have been proposed for permitting the remote placement of a golf tee into the ground and for permitting a remote placement of a golf ball on a tee. In U.S. Pat. Nos. 4,313,604 to Baxter and 4,466,650 to Roedel, two types of golf ball and tee handling implements are disclosed. In the use of each of these implements, the tee must first be placed in the ground and thereafter the ball cradled on the supporting cup of the tee. Such tools are not totally practical and require multiple handling of the golf ball and golf tee in order to set the golf ball and tee for driving. In addition, cradling or positioning the ball on the cup of the tee after the tee has been set into the ground often requires a great deal of extra manual dexterity which may require several attempts at accurately placing the ball on the tee especially when utilizing a long handled tool as disclosed in these inventions.

To overcome the problems of having to utilize separate steps to place a golf ball and tee, some implements have been developed which would permit the ball to be simultaneously placed on the tee as the tee is inserted into the ground. In U.S. Pat. No. 2,609,198 to Armstrong, one such type of tool or apparatus is disclosed wherein the tee is retained in a slot in the base of a semi-cylindrical housing in which the ball is selectively seated. An axially movable and spring-loaded rod having a cupped end portion is used to engage the ball against the cup of the tee and thereafter, the tool is urged vertically toward the ground driving the tee into a set position with the ball resting on the cup of the tee. Unfortunately, the driving portion of the tool must thereafter be retracted from the ball and the semi-cylindrical housing thereafter moved outward relative to both the tee and the ball. Such a structure requires that the tool be moved very carefully away from the ball and tee in order to prevent the implement from accidentally knocking the ball off the tee. In addition to the foregoing, such tools are limited in their use in that they are not designed to facilitate the retrieval of balls and tees once they have been placed on the ground.

In U.S. Pat. No. 3,904,200 to Jackle et al., another golf ball and tee positioning implement is disclosed having the ability to simultaneously set or place the ball and tee. The tool shown in Jackle overcomes some of the shortcomings of the prior art structures such as that disclosed in Armstrong by enabling the ball supporting and tee supporting portions of the implement to be automatically withdrawn from the ball and tee once the tee and ball are positioned in the ground. Unfortunately, however, the structure disclosed also requires additional manipulation of the tool to accomplish the positioning of the ball and tee relative to the tool prior to placement as the cup which supports the ball relative to the tee must be manually adjusted so as to bring it into engagement with the ball after the tee has been placed in the tool. This manipulation not only requires additional handling of the ball and tool but is also not exacting in maintaining constant pressure on the ball relative to the tee prior to and during the placement of the tee. Also, the tool is not designed to retrieve a ball or tee and therefore has limited use and application.

To overcome the shortcomings of other prior art structures, further development has been proposed with respect to golf ball and tee placement and retriever tools or implements. In U.S. Pat. No. 4,526,369 to Phelps, provision has been made for not only providing a mechanism for setting the tee and golf ball simultaneously but the structure also provides an elastomeric cup shaped element which is attached at the upper end of the implement and which may be utilized to retrieve a ball by forcing the cup shaped element over the ball and thereafter lifting the ball from the ground or from a golf cup. The cup shaped element is further provided with a pair of grooves which may be utilized to frictionally engage a tee which is lying on the ground in order to retrieve the tee. With such a structure, sufficient force must be applied by the cup shaped ball retrieving element to frictionally engage the ball relative to the cup. In many instances, the ball will not be positioned in an area which will permit such a compressive force to be exerted to positively seat the ball within the cup such as when the ball is in a shallow water area, in tall grass off a fairway, or in the sand of a rough. In these areas, the tool can not be forced over the ball in a manner which will create the frictional engagement necessary for the ball to be retained within the cup. Therefore, although the structure has been designed to facilitate the retrieval of golf balls and golf tees as well as providing a structure for setting golf balls and golf tees, the structure has its drawbacks and limitations.

Some additional examples of related prior art include U.S. Pat. Nos. 2,943,856 to Eimerman; 3,206,197 to Miotke and 3,889,946 to Setecka.

SUMMARY OF THE INVENTION

This invention is directed to a golf ball and tee placement and retrieval tool or implement which will permit a golf ball and golf tee to be either simultaneously placed for driving or separately retrieved from the ground, water, cup or other area without requiring a golfer to bend or stoop to accomplish such ball and tee manipulations. The tool includes an elongated shaft having a lower end portion which is provided with a ball engaging cup and ball alignment bracket member. The ball engaging cup and alignment bracket member are positioned between a pair of movable generally concavely shaped jaw members which are terminated at their lower ends by outwardly and downwardly extending concave grasping elements. The jaws are generally continuously resiliently urged apart from one another by the operating mechanism for the tool or implement. The concave jaws are mounted so that their upper end portions cross at a pivot point and are connected at their uppermost ends by a second pair of pivot links which are connected by way of a rod member to a control handle mounted on the upper portion of the elongated shaft of the implement. A spring is attached above the pivot links and provides a constant force to urge the gripping elements and jaws into an open or spaced relationship with respect to one another. Upon operation of the control handle, the rod member is urged to extend the scissored linkage and thereby force the gripping elements and jaws to close with respect to one another. Each of the gripping elements is formed having a generally semi-cylindrical surface having an elongated groove therein in which a golf tee may be selectively seated. The gripping elements not only provide a positive means for retaining the tee and restricting the movement of the ball when the tee is in position but also may be utilized to retrieve a tee or ball from the ground, the rough, sand or the cup on a green. To facilitate the use of the tool, the operating mechanism for the tool is designed to limit the outer extension of the jaws to a distance which is slightly less than the diameter of a conventional golf cup. The implement is also provided with a hook which may be utilized to suspend the tool from a golfer's belt or from a golf bag.

It is the primary object of the present invention to provide an apparatus for aiding golfers in teeing up balls and retrieving balls and tees which is not only lightweight and easy to manipulate but which may also be transported either on a person's belt or in a golfer's bag.

It is another object of the present invention to provide a tool for enabling the simultaneous placement of a golf ball and golf tee so that the ball is set for driving without requiring that the golfer stoop or bend in order to set the ball and tee in position.

It is a further object of the present invention to provide an apparatus for setting golf balls and golf tees which may also be used to retrieve tees and balls from the ground or other areas and which includes gripping elements which will insure the positive engagement of the tool with a ball or tee either in positioning or in retrieving such articles.

It is yet another object of the present invention to provide an apparatus which may be utilized by individuals having physical limitations which will allow such persons to be self-sufficient when playing a game of golf by permitting the ball and golf tee to be simultaneously inserted into the ground with the implement without the golfer bending or stooping. The implement also permits the retrieval of the ball and tee regardless of the area in which the golf ball or golf tee may lie with such retrieval being accomplished without requiring the golfer to bend or stoop.

It is also an object of the present invention to provide an aid for placing and retrieving golf balls and golf tees which is non-complex and lightweight in design and which may be economically manufactured thereby making it available at relatively low cost to the consuming public.

DESCRIPTION OF THE PREFERRED EMBODIMENT

Figure 1:
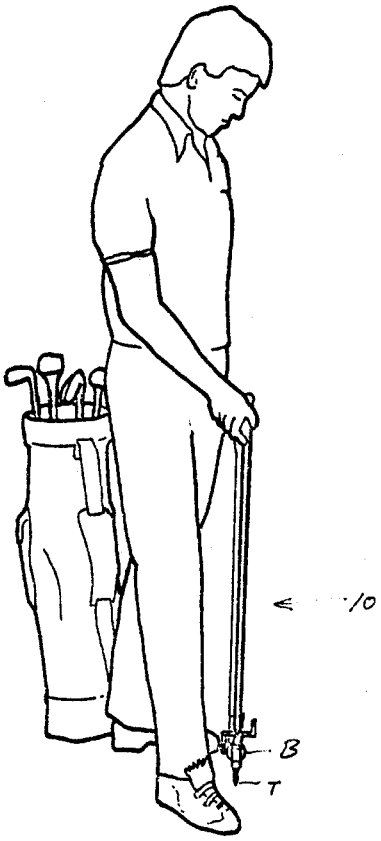
FIG. 1 is an illustrational view of the invention as it is being utilized by a golfer to simultaneously insert a golf ball and tee into the ground.

The golf ball and tee handling implement or tool 10 of the present invention is shown in FIG. 1 as it is being utilized by a golfer to simultaneously place a golf ball B and tee T into the ground so that the golf ball is set in a driving condition. The tool or implement 10 includes an elongated body portion or shaft 11 having upper and lower ends 12 and 13. A cap 14 is provided along the lower end and has a guide eyelet 15 secured thereto for purposes of which will be discussed in greater detail hereinafter. The upper end 12 of the shaft 11 is covered with a protective elastomeric cap 16 which may be utilized to grasp the upper end of the tool when the tool is in use.

Figure 3:
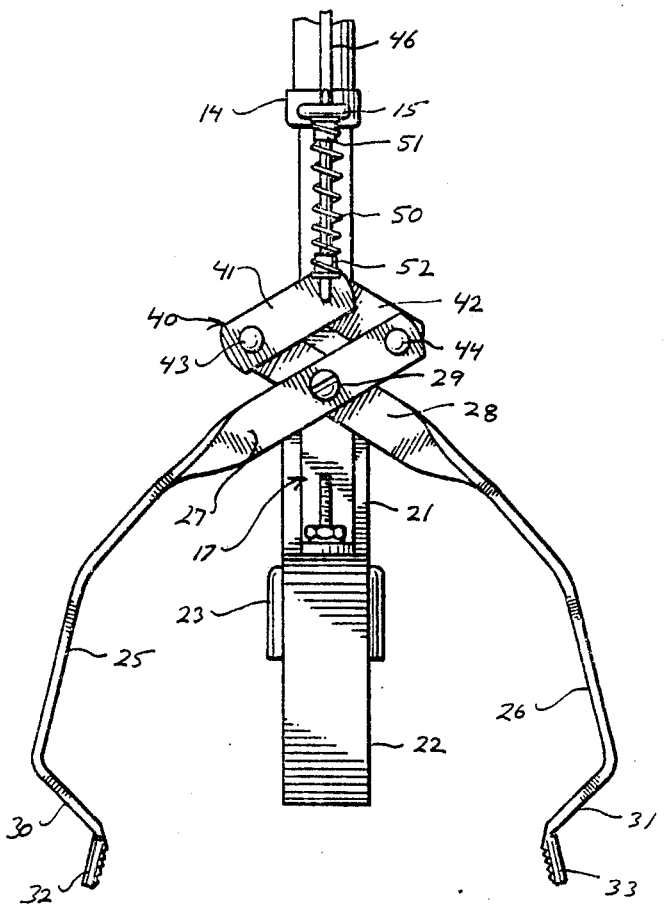
FIG. 3 is an enlarged partial side view taken from the right side of the apparatus as shown in FIG. 2.
Figure 4:
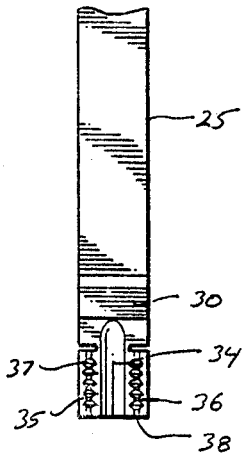
FIG. 4 is an enlarged view of one of the gripping end elements of the jaw members of the present invention.

An L-shaped bracket element 17 depends from the lower end of the shaft 11 and may be secured thereto in any conventional manner. The bracket 17 includes a vertically depending portion 18 and a horizontally oriented flange portion 19 to which a generally Z-shaped element 20 is selectively connected. The Z-shaped element includes an upwardly extending leg portion 21 which may be utilized as a hook to support the implement from a golfer's belt or from the edge of a golf bag. The Z-shaped element also includes a second leg portion 22 which extends downwardly away from the body or shaft portion of the implement and which serves as a cradle or alignment element for supporting the golf ball B relative to a golf stabilizing cup 23 which is fixedly mounted to both the bracket 17 and the cross body portion 24 of the Z-shaped bracket 20. As shown in FIG. 3, the ball stabilizing cup 23 may be threadingly secured to the Z-shaped bracket 20 and the bracket 17 although adjustment of the cup 23 is generally not necessary during the use of the implement.

Figure 2:
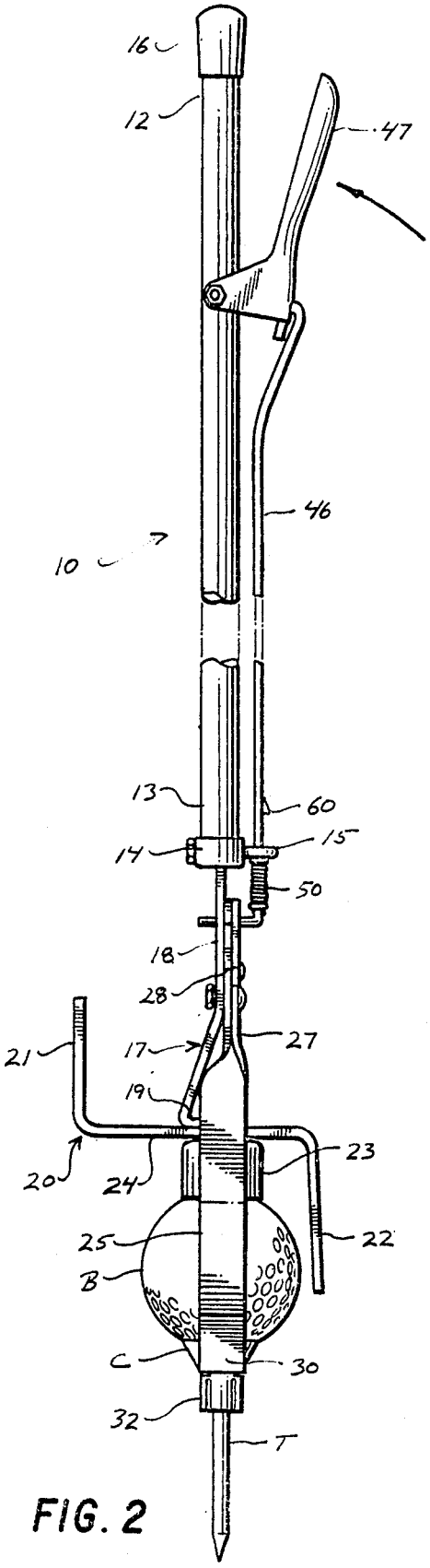
FIG. 2 is a front plan view of the apparatus of the invention showing the ball and tee positioned between the opposing jaws of the apparatus.

With particular reference to FIGS. 2 and 3, also mounted to the bracket 17 are a pair of opposing jaw elements 25 and 26. Although the jaw elements 25 and 26 are shown as being oriented in opposing relationship, their upper end portions 27 and 28, respectively, are shown as being in overlapping relationship with respect to one another and are secured to the bracket 17 by a pivot pin or screw 29. In this manner, the opposing jaw elements 25 and 26 are pivotably movable with respect to one another about the pivot pin or screw 29. Each of the jaw elements is generally concave in configuration and extends outwardly around the ball supporting cup 23 so as to be spaced therefrom when fully closed with respect to one another. The lowermost ends 30 and 31 of each of the jaw elements 25 and 26, respectively, extend inwardly toward one another so that such ends come into approximate contact with respect to each other when the jaws are fully closed. A pair of gripping elements 32 and 33 are integrally formed with the lowermost ends 30 and 31 of the jaws and extend downwardly therefrom. Each of the gripping elements is generally formed as a semi-cylinder and are defined having an inner concave or recessed portion 34 which extends longitudinally along the full length thereof. The opposite side walls 35 and 36 of each of the gripping elements are provided with a plurality of teeth or serrations 37 which enable the gripping elements to make firm contact with an object which is positioned therebetween. The length of the gripping elements 32 and 33 may be varied, however, an optimum length would be that which is necessary to insure the proper elevation of the cup C of the golf tee T relative to the ground as the tee is inserted therein. In this manner, the lowermost edges 38 of the gripping elements will serve as a stop to limit the penetration of the golf tee with respect to the ground during the placement of the golf ball and golf tee. In some instances, it may be preferred to provide some additional depth limiting member which would be attached to the leg portion 22 of the Z-shaped flange element in a manner not shown in the drawings.

With particular respect to FIG. 2, it is noted that the opposing jaw elements 25 and 26 are axially aligned with the central axis of the implement handle which axis also extends centrally through the ball retaining cup 23 and with the center axis of each of the grooves 34 in the gripping elements 32 and 33.

Operation of the jaw elements 25 and 26 is accomplished through a linkage assembly 40 which consists of a pair of movable links 41 and 42 which are pivotably secured at 43 and 44 adjacent the outermost end portions 27 and 28, respectively, of the opposing jaw elements. The opposite or overlapping ends of each of the links 41 and 42 are mounted over the end portion 45 of a control rod 46 which extends upwardly through the eyelet 15 to an operating handle 47. The operating handle is pivotally secured adjacent the upper end 12 of the shaft 11 by appropriate fasteners shown at 48.

The linkage mechanism 40 is designed to permit a scissor-type closing action which will effectually draw or move the opposing jaw elements 25 and 26 toward one another when the handle 47 is squeezed or pulled toward the body or shaft 11 of the tool. The jaws are normally positioned in a fully open position as shown in FIG. 3 under the influence of a spring element 50 which is mounted between a pair of abutment members 51 and 52 which are positioned adjacent the underside of the eyelet 15 and just above the lower end portion 45 of the control rod 46. The spring element 50 is normally retained under compression and therefore exerts a downward force on the linkage mechanism so that the linkage is in the position shown in FIG. 3 with the links 41 and 42 being extended into a generally horizontal position. Upon operation of the handle 47, the control rod 46 will be elevated drawing the links 41 and 42 upwardly and further collapsing the spring 50. In this position, the jaws 25 and 26 will be brought inwardly toward one another until the gripping elements 32 and 33 come into abutting engagement thereby defining an open channel between the grooves 38 formed in each of the gripping elements. This channel is utilized to provide a secure support for the golf tee T as is shown in FIG. 2.

Limitation of the outward movement of the jaws 25 and 26 is provided by fixing or welding a stop element 60 along the control rod 46 in a position spaced from the eyelet 15. The stop element 60 will effectively limit the amount of movement which is possible between the control rod and the fixed eyelet to thereby insure a maximum opening of the jaw elements.

In order to make the implement as lightweight and yet as durable as possible, it is preferred that the various components thereof be formed of aluminum or aluminum alloys with the exception of the spring element 50 and the ball retaining cup 23. The ball retaining cup 23 may be formed of a plastic material if preferred.

In the use of the implement of the present invention, when it is desired to set a ball and tee in place, the implement is raised so that the lower end 13 of the body or shaft 11 is raised relative to the ground. Thereafter, the ball is seated within the cup 23 which is in an upright position. The ball will be rested within the cup 23 and prevented from lateral movement by the leg portion 22 of the Z-shaped member 20. Thereafter the tee is placed between the jaws of the implement so that the shaft of the tee is positioned between the elongated grooves 34 formed in the grasping elements 32 and 33. A tee may thereafter be urged so that the cup portion thereof forces the ball B against the cup 23 whereupon handle 47 is closed toward the shaft 11 of the apparatus drawing the jaws and the gripping elements 32 and 33 into tight engagement with respect to one another thereby securing the tee and ball in relative relationship with respect to one another as shown in FIG. 2. Thereafter, the tool is inverted as shown in FIG. 1 and forced into the ground until the lower edge 38 of the gripping elements makes engagement with the ground at which the time the handle is released and the gripping elements 32 and 33 and jaws 25 and 26 are allowed to automatically retract away from the ball and tee under the influence of the spring element 50.

As discussed throughout the application, the implement of the present invention is also utilized to retrieve tees and balls which are on the ground, in the water or even in the cup on a green. In order to facilitate the retrieval of a ball from a cup, the jaws 25 and 26 have a maximum opening which is defined to be just slightly less than the diameter of a conventional golf cup or just slightly less than four inches. Further, the generally parallel leg portions 21 and 22 of the Z-shaped member 20 are spaced inwardly a distance less than the maximum opening distance of the jaws 25 and 26 so that such fixed elements will not interfere with the placement of the jaws into a cup to retrieve a ball. The gripping elements 32 and 33 are designed with a slight concave configuration with the serrations 37 being provided to positively engage a ball that may be positioned even in a remote location such as in shallow water, in deep grass off a fairway or in other hazard areas. The gripping jaws also may be utilized to successfully retrieve the golf tee from the ground as is necessary. When not in use, the implement is provided with the leg portion 21 of the Z-shaped bracket which serves as a hook to permit the implement to be placed over a golfer's belt or which may be utilized to suspend the implement from a golf bag.

I claim:

1. An apparatus for simultaneously positioning a golf ball and golf tee and for retrieving a golf ball and golf tee comprising an elongated shaft having upper and lower ends, a ball engaging socket member, means for mounting said socket member in fixed relationship to said lower end of said shaft, a pair of opposing generally concavely configured jaw elements movably mounted adjacent said lower end of said shaft and on opposite sides of said ball engaging socket member, each of said jaw elements having upper and lower ends, said jaw elements being pivotably connected to one another adjacent the upper end thereof, pivotable linkage means connected at said upper of said jaw elements, control rod means connected to said pivotable linkage means so that said linkage means are movable with respect thereto and extending from said pivotable linkage means towards said upper end of said shaft and being in generally spaced parallel relationship thereto, handle means secured adjacent said upper end of said shaft and connected to said control rod means so as to effectuate the movement of said control rod means by said handle means, a pair of depending gripping elements carried by said lower end of said opposing jaw elements, said gripping elements being formed having opposed generally concave surfaces defining a groove along the length thereof, and resilient means connected to said pivotable linkage means for normally urging said gripping elements and said jaw elements outwardly with respect to one another.

2. The apparatus of claim 1 including serrations disposed on either side of said groove in each of said gripping elements.

3. The apparatus of claim 1 including a fixed bracket member extending from said lower end of said shaft portion, said ball engaging socket member being secured to said fixed bracket member.

4. The apparatus of claim 3 including a Z-shaped bracket member secured to said fixed bracket member adjacent said ball engaging socket member, said Z-shaped bracket having a first leg extending adjacent to said ball engaging socket member and toward said gripping elements carried by said jaw means and a second leg extending upwardly toward said upper end of said shaft.

5. The apparatus of claim 1 in which said opposing jaw members have a maximum displacement with respect to one another of a distance which is less than the conventional diameter of the cup in a golf green.

6. An apparatus for simultaneously positioning a golf ball and golf tee comprising an elongated shaft having upper and lower ends, a ball engaging socket member carried by said lower end of said shaft a pair of opposing generally concavely configured jaw elements movably mounted adjacent said lower end of said shaft and on opposite sides of said ball engaging socket member, each of said jaw elements having upper and lower ends, said upper ends of said jaw elements being pivotable with respect to one another, linkage means connected adjacent said upper ends of said jaw elements, control rod means extending from said linkage means towards said upper end of said shaft, handle means secured adjacent said upper end of said shaft and connected to said control rod means so as to effectuate movement of said control rod means by said handle means, a pair of depending gripping elements carried by said lower ends of said opposing jaw elements, each of said gripping elements having an opposing generally concave surface at said lower ends defining a groove along the length thereof, resilient means connected to said linkage means for normally urging said gripping elements and said jaw elements outwardly with respect to one another, a fixed bracket member extending from said lower ends of said shaft, said ball engaging socket member being secured to said fixed bracket member, a Z-shaped bracket member secured to said fixed bracket member adjacent said ball engaging socket member, and said Z-shaped bracket having a first leg extending adjacent to said ball engaging socket member and toward said gripping elements carried by said jaw means and a second leg extending upwardly toward said upper ends of said shaft.

7. The apparatus of claim 6 including at least one guide means attached to said shaft, said control rod means extending through said guide means.

8. The apparatus of claim 7 including stop means carried by said control rod means adjacent said guide means, said stop means limiting the movement of said control rod means relative to said guide means.

* * * * *